US009266253B2

(12) United States Patent
Huang et al.

(10) Patent No.: US 9,266,253 B2
(45) Date of Patent: Feb. 23, 2016

(54) ELECTRIC DOUBLE-BLADE SLOT CUTTING MACHINE

(71) Applicant: HAMMER ELECTRIC POWER TOOLS CO.,LTD., Zhuji, Zhejiang (CN)

(72) Inventors: Liang Huang, Zhejiang (CN); Chengye Wu, Zhejiang (CN); Ligang Zhu, Zhejiang (CN)

(73) Assignee: HAMMER ELECTRIC POWER TOOLS CO., LTD., Zhuji, Zhejiang (CN)

( * ) Notice: Subject to any disclaimer, the term of this patent is extended or adjusted under 35 U.S.C. 154(b) by 156 days.

(21) Appl. No.: 14/116,773

(22) PCT Filed: Jun. 19, 2013

(86) PCT No.: PCT/CN2013/077458

§ 371 (c)(1),
(2) Date: Nov. 11, 2013

(87) PCT Pub. No.: WO2014/198072

PCT Pub. Date: Dec. 18, 2014

(65) Prior Publication Data

US 2015/0202798 A1 Jul. 23, 2015

(30) Foreign Application Priority Data

Jun. 9, 2013 (CN) ..... 2013 1 0231095

(51) Int. Cl.

| | |
|---|---|
| ***B28D 1/22*** | (2006.01) |
| ***B25F 5/00*** | (2006.01) |
| ***B28D 1/06*** | (2006.01) |
| ***B25F 5/02*** | (2006.01) |

(52) U.S. Cl.
CPC . *B28D 1/228* (2013.01); *B25F 5/00* (2013.01); *B25F 5/001* (2013.01); *B25F 5/02* (2013.01); *B28D 1/064* (2013.01)

(58) Field of Classification Search
CPC ..... B28D 1/228; B25F 5/001; B25F 5/02; B25F 5/00; B25D 1/068
USPC ..... 30/392, 277.4, 166.3, 369, 746, 393, 30/394, 386, 383, 501, 502; 83/835, 746, 83/748, 751, 849, 699.21, 821, 698.71; 606/82, 79, 169, 171, 176, 178
See application file for complete search history.

(56) References Cited

U.S. PATENT DOCUMENTS

| | | | | | |
|---|---|---|---|---|---|
| 3,763,562 | A * | 10/1973 | Schultz | 30/166.3 |
| 5,473,820 | A * | 12/1995 | Neubert et al. | 30/386 |
| 5,846,244 | A * | 12/1998 | Cripe | 606/82 |
| 6,094,826 | A * | 8/2000 | Schmidt | 30/369 |
| 2011/0046627 | A1* | 2/2011 | Kim | 606/82 |
| 2013/0247391 | A1* | 9/2013 | Armstrong | 30/392 |

* cited by examiner

*Primary Examiner* — Ghassem Alie

(57) ABSTRACT

An electric double-blade slot cutting machine include a first cutting unit having a first cutting part and provided along a cutting route and presents a reciprocating movement; a second cutting unit having a second cutting part provided along the cutting route and presents the reciprocating movement, wherein moving directions of the first cutting unit and the second cutting unit is opposite while cutting; a restriction holder for restricting the first cutting unit and the second cutting unit to moving along the cutting route; a transmission unit; and a motor. With the foregoing structure, the electric double-blade slot cutting machine can work with small vibration and stable performances; a speed of the motor is increased for improving work efficiency; and with an extension rod, the electric double-blade slot cutting machine is adaptable for standing utilization.

11 Claims, 6 Drawing Sheets

A – A

ELECTRIC DOUBLE-BLADE SLOT CUTTING MACHINE

CROSS REFERENCE OF RELATED APPLICATION

This is a U.S. National Stage under 35 U.S.C 371 of the International Application PCT/CN2013/077458, filed Jun. 19, 2013, which claims priority under 35 U.S.C. 119(a-d) to CN 201310231095.3, filed Jun. 09, 2013.

BACKGROUND OF THE PRESENT INVENTION

1. Field of Invention

The present invention relates to an electric double-blade slot cutting machine, and more particularly to a reciprocating electric double-blade slot cutting machine.

2. Description of Related Arts

A conventional slot cutting machine utilizes a one-blade design. When the blade moves up and down, great vibration will occur. Therefore, an user can not use the machine stably, and it won't be long before hands get numb. At the mean time, a speed of a motor is limited to 800~2800 rpm because of the great vibration, and work efficiency is badly affected. Further more, because of the great vibration, an extension rod can not adapt to the conventional slot cutting machine. If ground should be cut, the user must bend or squat, and that's very tiring. In addition, the conventional slot cutting machine can adapt to only one kind of material. And for cutting a variety of materials, different conventional slot cutting machines should be purchased.

SUMMARY OF THE PRESENT INVENTION

An object of the present invention is to provide an electric double-blade slot cutting machine with small vibration, stable performances and sufficient cutting effects.

Another object of the present invention is to provide an electric double-blade slot cutting machine with high efficiency and high economic value.

Another object of the present invention is to provide an electric double-blade slot cutting machine capable of being continuously utilized for a long time because of an advantage of unlikely causing fatigue.

Another object of the present invention is to provide an electric double-blade slot cutting machine capable of being utilized by a standing user.

Another object of the present invention is to provide an electric double-blade slot cutting machine adapting to a variety of materials.

Accordingly, in order to accomplish the above objects, the present invention provides an electric double-blade slot cutting machine, comprising:

a first cutting unit, comprising a first blade and a first blade holder, wherein the first blade is mounted on the first blade holder, wherein the first blade has a first cutting part provided on an edge thereof, the first cutting unit is provided along a cutting route back and forward, and the first cutting unit has a first moving direction, the first cutting part extends along the cutting route;

a second cutting unit, comprising a second blade and a second blade holder, wherein the second blade is mounted on the second blade holder, wherein the second blade has a second cutting part provided on an edge thereof, the second cutting unit is provided along the cutting route back and forward, and the second cutting unit has a second moving direction, wherein the first moving direction is opposite to the second moving direction in such a manner that resistance on the first blade counteracts resistance on the second blade while cutting, the cutting part extends along the cutting route;

a restriction holder for restricting the first cutting unit and the second cutting unit to moving along the cutting route;

a transmission unit respectively connected to the first blade holder and the second blade holder, wherein the transmission unit drives the first cutting unit and the second cutting unit to move along the cutting route; and a motor for driving the transmission unit.

Therefore, with the foregoing structure, the present invention has advantages as follows: 1. because of a double-blade design, the vibration is small. The performances are stable and hands are not tired easily. 2. because of the stable performances, a speed of the motor can be increased from 800~2800 rpm to 6000 rpm in such a manner that work efficiency is improved to 114%~650%. 3. because double-blade technology is utilized for stabilizing the performance, an extension rod can be utilized in such a manner that the user can stand while working.

These and other objectives, features, and advantages of the present invention will become apparent from the following detailed description, the accompanying drawings, and the appended claims.

Figure 1:
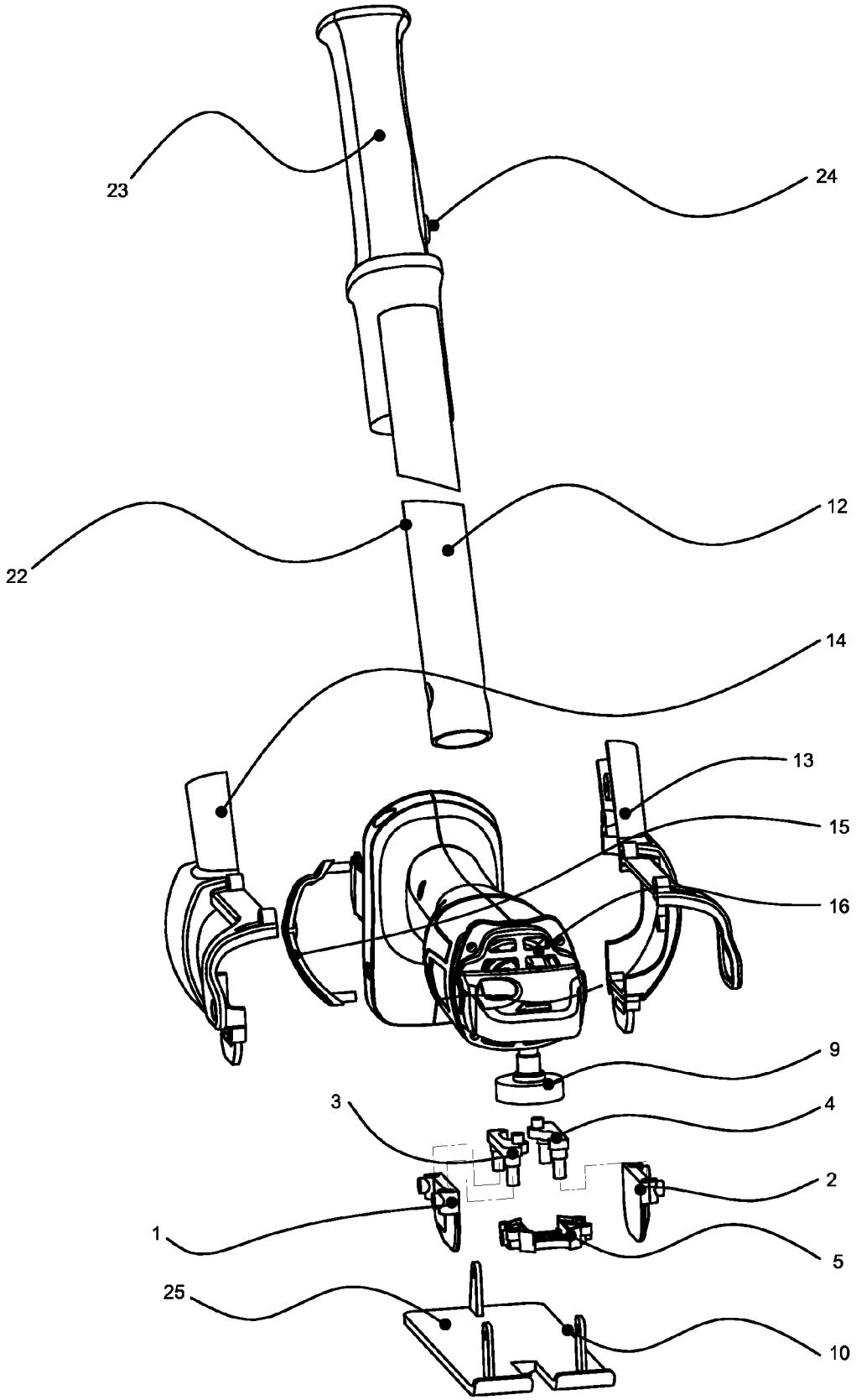
FIG. 1 is an exploded view of the present invention according to a preferred embodiment of the present invention.
Figure 2:
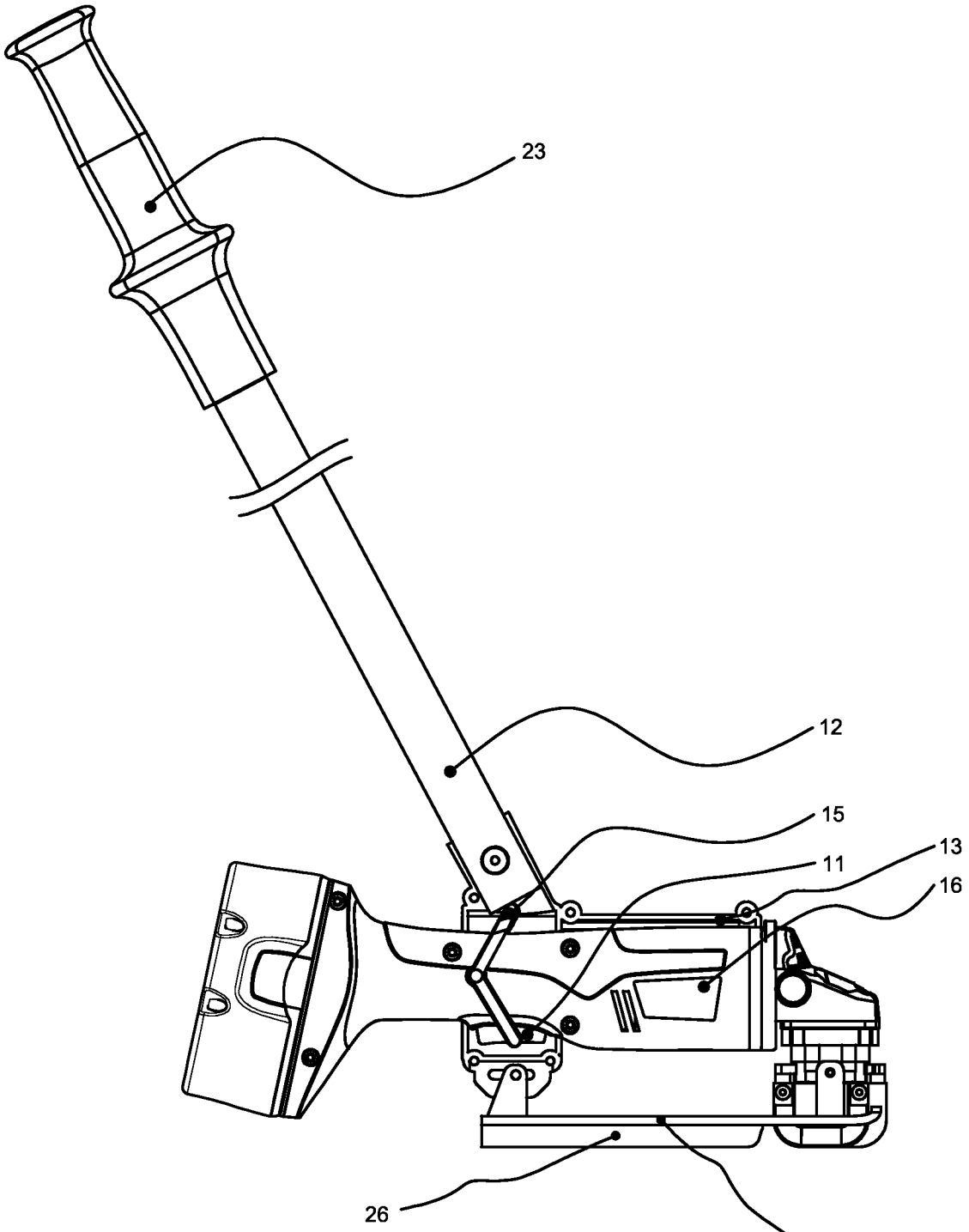
FIG. 2 is a side structure view of the present invention according to the preferred embodiment of the present invention.
Figure 3:
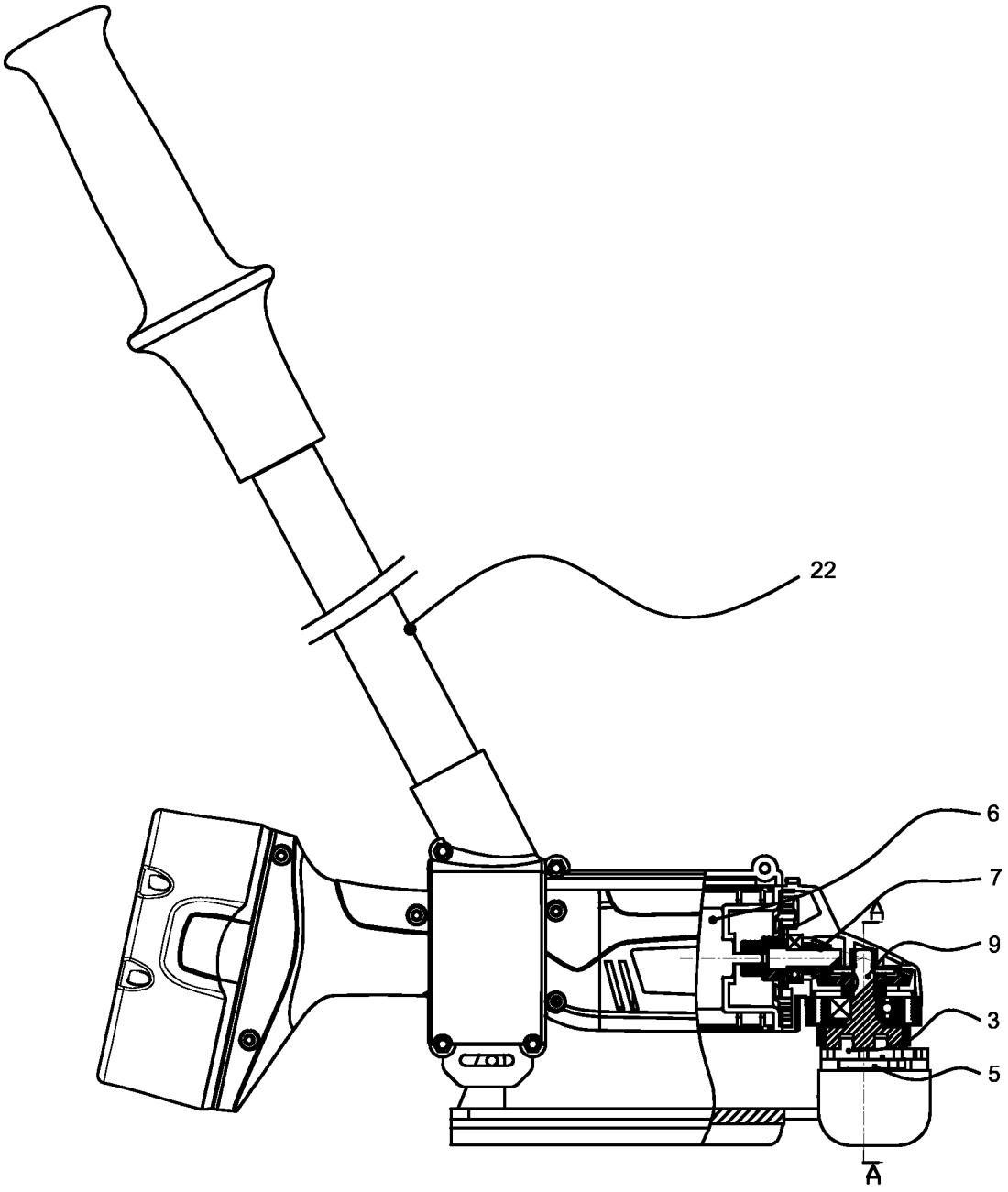
FIG. 3 is a side sectional view of the transmission unit of the present invention according to the preferred embodiment of the present invention.
Figure 4:
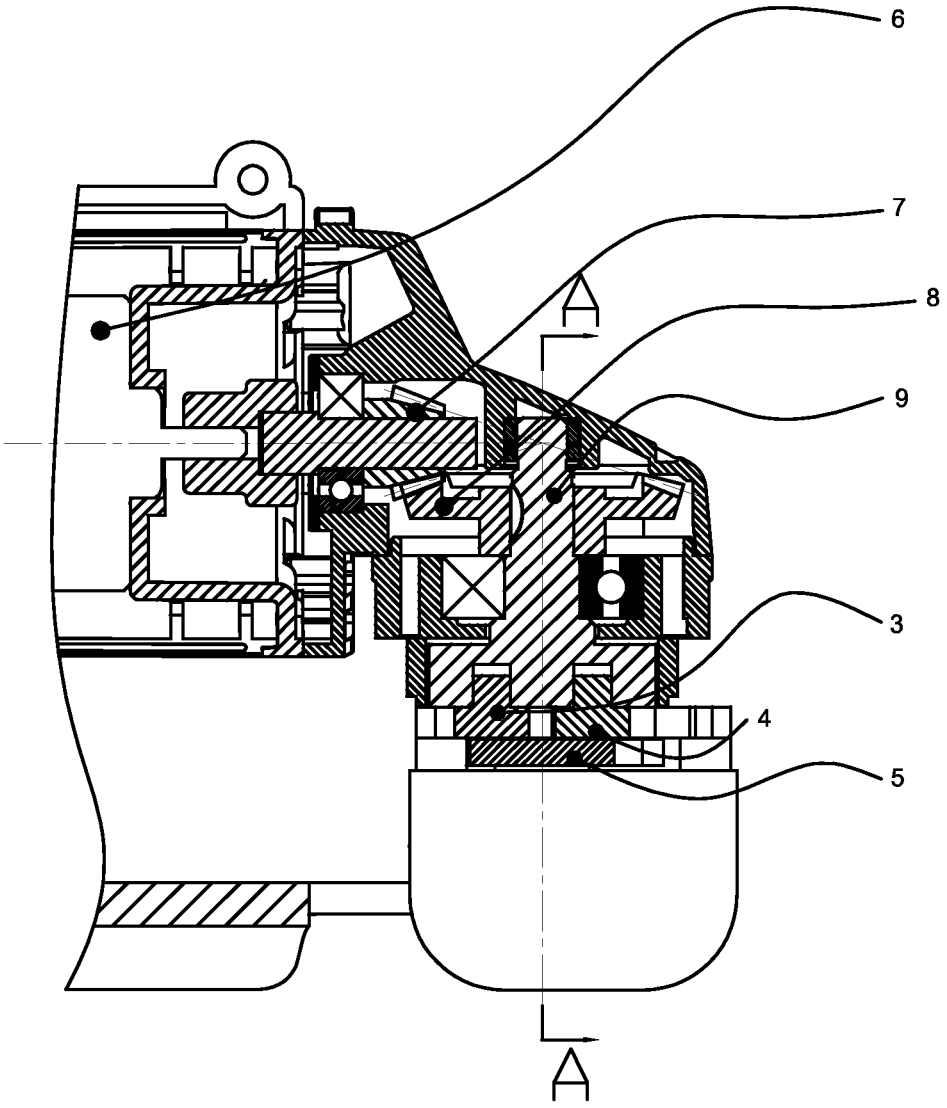
FIG. 4 is a partial enlarged view of the present invention according to the preferred embodiment of the present invention.
Figure 5:
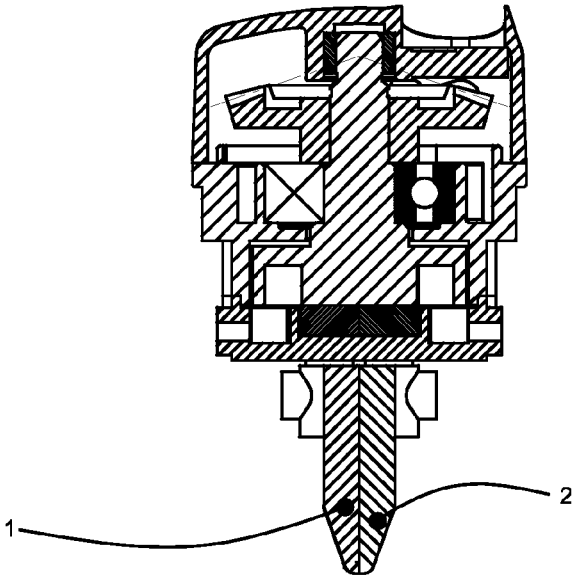
FIG. 5 is an A-A direction sectional view of the present invention according to the preferred embodiment of the present invention.
Figure 6:
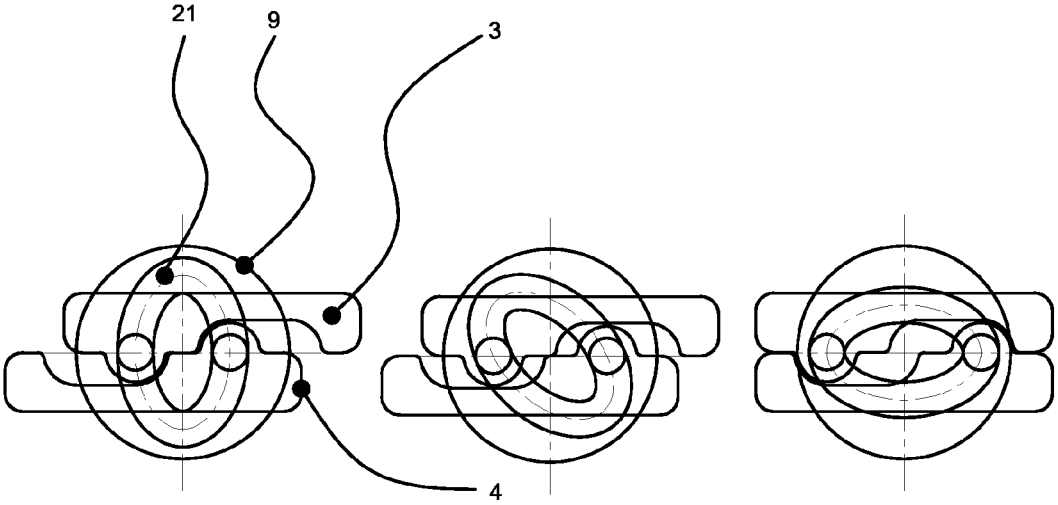
FIG. 6 is a movement state sketch of the cutting units and the flange slot of the present invention according to the preferred embodiment of the present invention.
Figure 7:
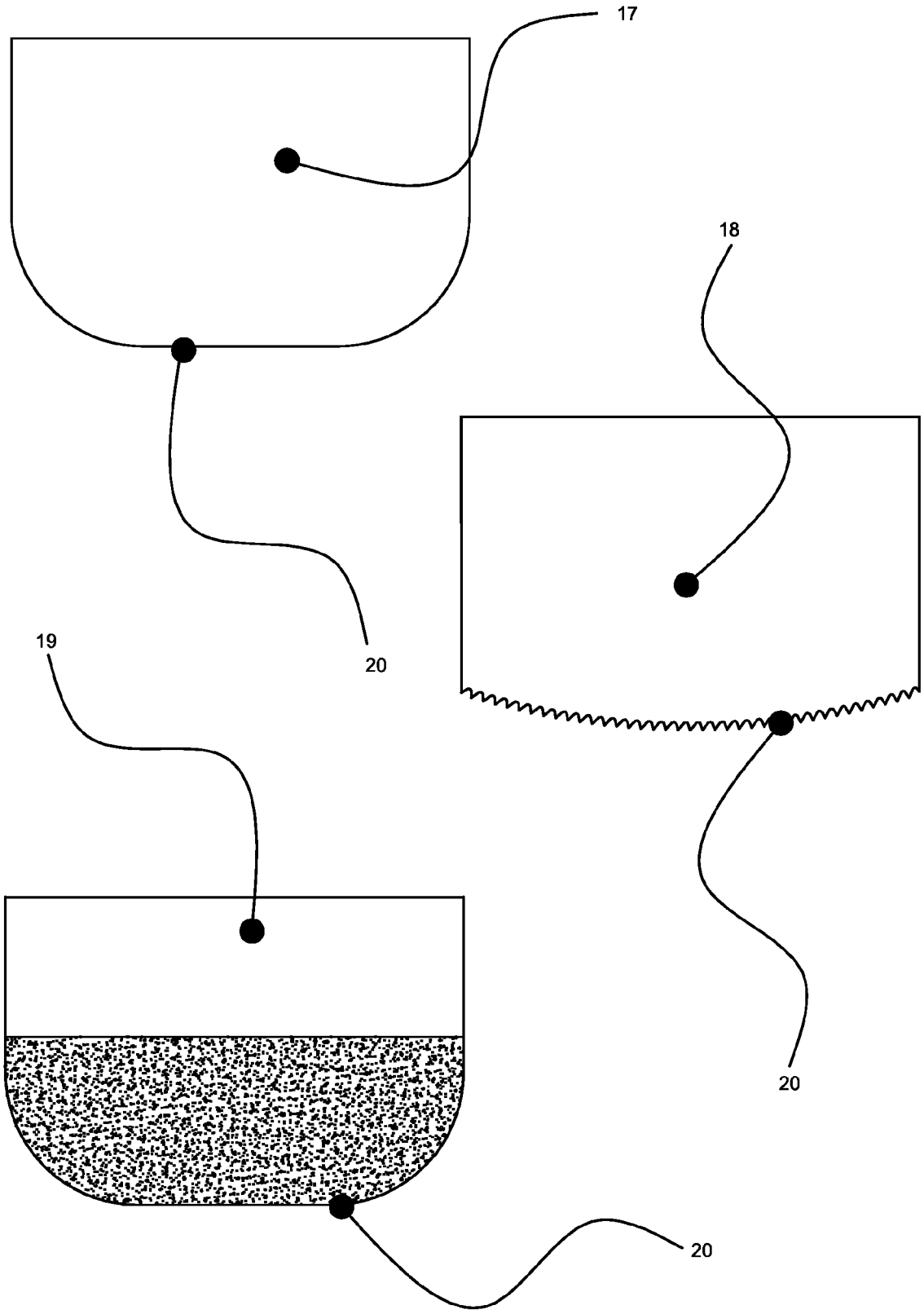
FIG. 7 is a sketch of the blades of the present invention according to the preferred embodiment of the present invention.

Reference numbers of elements: 1-first blade, 2-second blade, 3-first blade holder, 4-second blade holder, 5-restriction holder, 6-motor, 7-smaller bevel gear, 8-bigger bevel gear, 9-main axle, 10-leading board, 11-switch, 12-extension rod, 13-left fixture, 14-right fixture, 15-switch connecting rod, 16-main body, 17-half-dried cement cutting blade, 18-metal cutting blade, 19-ceramic tile cutting blade, 20-cutting part, 21-flange slot, 22-rod body, 23-handle, 24-trigger, 25-division plate, 26-leading blade.

DETAILED DESCRIPTION OF THE PREFERRED EMBODIMENT

Referring to the drawings, an electric double-blade slot cutting machine according to a preferred embodiment of the present invention is illustrated, comprising:

a first cutting unit, comprising a first blade 1 and a first blade holder 3, wherein the first blade 1 is mounted on the first blade holder 3, wherein the first blade 1 has a first cutting part 20 provided on an edge thereof, the first cutting unit is provided along a cutting route back and forward, and the first cutting unit has a first moving direction, the first cutting part 20 extends along the cutting route;

a second cutting unit, comprising a second blade 2 and a second blade holder 4, wherein the second blade 2 is mounted on the second blade holder 4, wherein the second blade 2 has a second cutting part 20 provided on an edge thereof, the second cutting unit is provided along the cutting route back and forward, and the second cutting unit has a second moving direction, wherein the first moving direction is opposite to the second moving direction in such a manner that resistance on the first blade 1 counteracts resistance on the second blade 2 while cutting, the cutting part 20 extends along the cutting route;

a restriction holder 5 for restricting the first cutting unit and the second cutting unit to moving along the cutting route;

a transmission unit respectively connected to the first blade holder 3 and the second blade holder 4, wherein the transmission unit drives the first cutting unit and the second cutting unit to move along the cutting route; and a motor 6 for driving the transmission unit.

With the foregoing structure, the electric double-blade cutting machine can cut with two blades for improving cutting efficiency. And a movement phase of the first cutting unit is opposite to the movement phase of the second cutting unit. That is to say, when the first cutting unit moves forward, the second cutting unit moves backward; and when the first cutting unit moves backward, the second cutting unit moves forward. Therefore, the resistance and impact force on the first cutting unit while cutting are counteracted by the resistance and impact force on the second cutting unit in such a manner that the vibration is decreased and the performance is stabilized.

Preferably, the first blade 1 and the second blade 2 are half-dried cement cutting blades 17, the first cutting part 20 and the second cutting part 20 are straight cutting parts.

Preferably, the first blade 1 and the second blade 2 are metal cutting blades 18, the first cutting part 20 and the second cutting part 20 are serrated cutting parts.

Preferably, the first blade 1 and the second blade 2 are ceramic tile cutting blades 19, the first cutting part 20 and the second cutting part 20 are emery cutting parts.

With the foregoing structure, the electric double-blade cutting machine can adapt to a variety of materials such as half-dried cement, metal and ceramic tile.

Preferably, the transmission unit further comprises:

a smaller bevel gear 7 mounted on the motor 6;

a bigger bevel gear 8 mounted on a main axle 9, wherein the bigger bevel gear 8 is engaged with the smaller bevel gear 7 for driving the main axle 9 to rotate when the motor 6 works; and a flange slot 21 mounted on an end of the main axle 9, wherein the flange slot 21 is a oval-shaped slot, a oval plane of the flange slot 21 is perpendicular to an axial direction of the main axle 9, the flange slot 21 rotates with the main axle 9.

Wherein the first blade 1 is mounted on the first blade holder 3 by a first fastening screw, the second blade 2 is mounted on the second blade holder 4 by a second fastening screw, the first blade holder 3 has a first flange, the second blade holder 4 has a second flange, the first flange and the second flange are respectively engaged with the flange slot 21.

Wherein the first flange is provided at a first end point of an oval diameter of the flange slot 21, the second flange is provided at a second end point of the oval diameter of the flange slot 21, a diameter direction of the oval diameter is parallel to the cutting route in such a manner that when the main axle 9 rotates, the flange slot 21 rotates with the main axle 9 and drives the first cutting unit and the second cutting unit to respectively present the reciprocating movement along the cutting route under a direction restriction of the restriction holder 5.

With the foregoing structure, the movement phase of the first cutting unit is opposite to the movement phase of the second cutting unit while cutting for decreasing the vibration and stabilizing the performance, therefore, a speed of the motor 6 is increased from 800~2800 rpm to 6000 rpm in such a manner that the work efficiency is improved by 114%~450% and hands are not tired easily.

Preferably, the electric double-blade slot cutting machine further comprises a leading board 10 detachably mounted on a main body 16 of the electric double-blade slot cutting machine, wherein the leading board 10 further comprises:

a division plate 25 for contacting with a surface of a cutting target for limiting the cutting depth; and a leading blade 26 for keeping the heading direction, wherein the leading blade 26 is mounted on the division plate 25 and provided along the cutting route and behind the first blade 1 and the second blade 2, a third thickness of the leading blade 26 is not larger than a total thickness of a first thickness of the first blade 1 and a second thickness of the second blade 2, a width of the leading blade 26 is not larger than the cutting depth, the leading blade 26 reaches into a cut slot for keeping the heading direction.

With the foregoing structure, when cutting, the leading blade 26 reaches into the cut slot and is held by sides of the cut slot for keeping the original direction, at the meantime, the division plate 25 contacts with the surface of the cutting target for preventing the electric double-blade cutting machine from cutting deeper in such a manner that the cutting depth is limited.

Preferably, the electric double-blade slot cutting machine further comprises a switch 11 for controlling the motor 6.

Preferably, the electric double-blade slot cutting machine further comprises a detachable extension rod 12 for increasing an operable range.

Wherein the detachable extension rod 12 further comprises:

a rod body 22 having a first end and a second end;

a left fixture 13;

a right fixture 14, wherein the right fixture 14, the left fixture 13, the first end of the rod body 22 and the main body 16 of the electric double-blade slot cutting machine are fixed together by a fastener;

a switch connecting rod 15 for operating the switch 11; and a handle 23 mounted on the second end of the rod body 22, wherein the handle 23 has a trigger 24 for triggering the switch connecting rod 15 in such a manner that the switch 11 is operated through operating the handle 23.

With the foregoing structure, when ground should be cut, the user doesn't need to bend or squat, and with the help of the detachable extension rod 12, a standing user can easily operates the electric double-blade cutting machine, therefore, work load is greatly decreased and bad effects due to bending and squatting for a long time are avoided.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An electric double-blade slot cutting machine, comprising:

a first cutting unit, comprising a first blade and a first blade holder, wherein said first blade is mounted on said first blade holder, wherein said first blade has a first cutting part provided on an edge thereof, said first cutting unit is provided along a cutting route back and forward, and said first cutting unit has a first moving direction, said first cutting part extends along said cutting route;

a second cutting unit, comprising a second blade and a second blade holder, wherein said second blade is mounted on said second blade holder, wherein said second blade has a second cutting part provided on an edge thereof, said second cutting unit is provided along said cutting route back and forward, and said second cutting unit has a second moving direction, wherein said first moving direction is opposite to said second moving direction in such a manner that resistance on said first blade counteracts resistance on said second blade while cutting, said cutting part extends along said cutting route;

a restriction holder for restricting said first cutting unit and said second cutting unit to moving along said cutting route;

a transmission unit respectively connected to said first blade holder and said second blade holder, wherein said transmission unit drives said first cutting unit and said second cutting unit to move along said cutting route; and a motor for driving said transmission unit;

wherein said transmission unit comprises:

a smaller bevel gear mounted on said motor;

a bigger bevel gear mounted on a main axle, wherein said bigger bevel gear is engaged with said smaller bevel gear for driving said main axle to rotate when said motor works; and a flange slot mounted on an end of said main axle, wherein said flange slot is an oval-shaped slot, an oval plane of said flange slot is perpendicular to an axial direction of said main axle, said flange slot rotates with said main axle;

wherein said first blade is mounted on said first blade holder, said second blade is mounted on said second blade holder, said first blade holder has a first flange, said second blade holder has a second flange, said first flange and said second flange are respectively engaged with said flange slot, in such a manner that said transmission unit drives said first cutting unit and said second cutting unit to move.

2. The electric double-blade slot cutting machine, as recited in claim 1, wherein said first blade and said second blade are half-dried cement cutting blades, said first cutting part and said second cutting part are straight cutting parts.

3. The electric double-blade slot cutting machine, as recited in claim 1, wherein said first blade and said second blade are metal cutting blades, said first cutting part and said second cutting part are serrated cutting parts.

4. The electric double-blade slot cutting machine, as recited in claim 1, wherein said first blade and said second blade are ceramic tile cutting blades, said first cutting part and said second cutting part are emery cutting parts.

5. The electric double-blade slot cutting machine, as recited in claim 4, wherein said first flange is provided at a first end point of an oval diameter of said flange slot, said second flange is provided at a second end point of said oval diameter of said flange slot, a diameter direction of said oval diameter is parallel to said cutting route in such a manner that when said main axle rotates, said flange slot rotates with said main axle and drives said first cutting unit and said second cutting unit to respectively present said reciprocating movement along said cutting route under a direction restriction of said restriction holder.

6. The electric double-blade slot cutting machine, as recited in claim 1, wherein a first movement phase of said first cutting unit is opposite to a second movement phase of said second cutting unit.

7. The electric double-blade slot cutting machine, as recited in claim 1, further comprising a leading board detachably mounted on a main body of said electric double-blade slot cutting machine, wherein said leading board is capable of limiting a cutting depth and keeping a heading direction.

8. The electric double-blade slot cutting machine, as recited in claim 7, wherein said detachable extension rod further comprises:

a rod body having a first end and a second end;

a left fixture;

a right fixture, wherein said right fixture, said left fixture, said first end of said rod body and said main body of said electric double-blade slot cutting machine are fixed together by a fastener;

a switch connecting rod for operating said switch; and a handle mounted on said second end of said rod body, wherein said handle has a trigger for triggering said switch connecting rod in such a manner that said switch is operated through operating said handle.

9. The electric double-blade slot cutting machine, as recited in claim 1, wherein said leading board further comprises:

a division plate for contacting with a surface of a cutting target for limiting said cutting depth; and a leading blade for keeping said heading direction, wherein said leading blade is mounted on said division plate and provided along said cutting route and behind said first blade and said second blade, a third thickness of said leading blade is not larger than a total thickness of a first thickness of said first blade and a second thickness of said second blade, a width of said leading blade is not larger than said cutting depth, said leading blade reaches into a cut slot for keeping said heading direction.

10. The electric double-blade slot cutting machine, as recited in claim 1, further comprising a switch for controlling said motor.

11. The electric double-blade slot cutting machine, as recited in claim 1, further comprising a detachable extension rod for increasing an operable range.

* * * * *